US005749252A

United States Patent [19]

Rhoades

[11] Patent Number: 5,749,252

[45] Date of Patent: May 12, 1998

[54] MANIPULATION RESISTANT COMBINATION LOCK AND METHOD

[75] Inventor: Martin Richard Rhoades, Lexington, Ky.

[73] Assignee: Sargent & Greenleaf, Nicholasville, Ky.

[21] Appl. No.: 632,577

[22] Filed: Apr. 15, 1996

[51] Int. Cl.[6] ..... E05B 37/08; E05B 47/00

[52] U.S. Cl. ..... 70/276; 70/295; 70/303 A; 70/322; 70/333 R

[58] Field of Search ..... 70/276, 303 R, 70/303 A, 333 R, 295, 301, 302, 320, 321, 322, 442, 444

[56] References Cited

U.S. PATENT DOCUMENTS

| | | | |
|---|---|---|---|
| 10,518 | 2/1854 | Knowles . | |
| 47,575 | 5/1865 | Sargent et al. . | |
| 57,574 | 8/1866 | Sargent . | |
| 98,622 | 1/1870 | Sargent . | |
| 117,478 | 7/1871 | Stockwell . | |
| 299,695 | 6/1884 | Stockwell . | |
| 2,655,807 | 10/1953 | Bateman | 70/333 R |
| 2,779,185 | 1/1957 | Papini | 70/333 R |
| 3,170,316 | 2/1965 | Miller et al. | 70/333 R |
| 3,339,383 | 9/1967 | Miller et al. | 70/333 R |
| 3,968,667 | 7/1976 | Gartner et al. | 70/303 A |
| 4,756,176 | 7/1988 | Uyeda | 70/303 A |
| 5,473,919 | 12/1995 | Abner et al. | 70/276 |

FOREIGN PATENT DOCUMENTS

| | | | |
|---|---|---|---|
| 2816969 | 10/1979 | Germany | 70/303 A |

*Primary Examiner*—Lloyd A. Gall
*Attorney, Agent, or Firm*—Reid & Priest LLP

[57] ABSTRACT

A manipulation resistant combination lock includes a housing, a drive cam attached a drive shaft, a moveable bolt, a fence attached to a fence lever, and tumbler wheels. A fence lever is pivotally attached to the bolt, and has a nose portion engageable with a drive cam gate in the drive cam which is keyed to the drive shaft and includes two spaced multi-surface contact rollers of magnetically attractable material on opposite sides of the drive cam gate. Each contact roller has a plurality of non-identical surfaces which is uniquely radially positioned and oriented relative to the axis of rotation of each contact roller. A permanent magnet is mounted in the nose portion of the fence lever thereon to assert an attraction force which rotates the contact roller as the contact roller approaches the nose portion of the fence lever due to rotation of the drive cam. The nose portion physically contacts the contact roller and causes it to rotate to a new position of rotation in which a different surface of the roller is positioned to contact the nose during subsequent rotation of the cam, so as to defeat successful manipulation of the lock.

18 Claims, 1 Drawing Sheet

MANIPULATION RESISTANT COMBINATION LOCK AND METHOD

BACKGROUND OF THE INVENTION

1. Field of the Invention

The present invention is in the field of combination locks. More specifically, the invention relates to a manipulation proof combination lock and method which provide absolute security from opening by a lock manipulator.

A long standing problem with respect to combination locks has existed as a consequence of the skills of lock manipulators who use the senses of feel, sight and sound while manipulating the lock dial to ascertain the combination. Normally, the manipulator will initially discover the numbers employed in the combination and will then ascertain the proper sequence of such numbers through arduous trial and error procedures. A variety of prior devices have been employed for reducing the "feel" of the dial of combination locks as well as reducing the sound emitted by the operation of the internal components. Unfortunately, the efforts of lock makers have not been fully successful in defeating manipulators.

Therefore, it is the object of the present invention to provide a new and improved combination lock which operates in a manner to defeat a manipulator by randomly varying the "feel" and sound of the lock to preclude the manipulator from being able to detect the positioning of the tumblers necessary to effect alignment of the tumbler gates to permit opening of the lock.

2. Related Art

Prior U.S. Pat. No. 117,478 discloses a plurality of eccentric rollers D' mounted on a fence B so as to peripherally engage corresponding tumblers with eccentric roller means E being mounted on the depending end of a fence lever D for engaging the periphery of a cam F. Similarly, Stockwell, U.S. Pat. No. 10,518 and related U.S. Pat. No. 299,695 both disclose the use of a slightly eccentric anti-friction roller n mounted on the dog portion of a fence G to peripherally engage the tumblers of a combination lock.

Sargent U.S. Pat. No. 98,622 discloses the use of plural eccentric rollers H' coaxially mounted with a non-eccentric roller H with the eccentric rollers intermittently engaging the surface of the cam to create false signals in an effort to defeat manipulation of the lock.

Prior known combination locks, such as those disclosed in the U.S. Pat. Nos. 4,756,176 and 5,473,919, which are incorporated herein by reference, have employed a fence lever control device which includes means for normally keeping the nose of the fence lever spaced outwardly from the drive cam and only moving the fence lever and its associated nose toward the drive cam when the tumbler gates are aligned with one another and are ready to receive the fence member to permit the authorized opening of the lock. The inventions of the above noted prior art patents employ means for keeping the nose of the fence lever spaced from the drive cam in order to prevent a lock manipulator from determining the position of the drive cam gate and then manipulating the lock parts in a predetermined manner to bring the fence member into the gates of the tumbler wheel assemblies while the lever nose is simultaneously moved into the drive cam gate so as to permit opening of the lock by subsequent rotation of the drive cam. However, such prior known mechanisms have been fairly complicated to manufacture and are not well adapted to ease of assembly techniques in mass production of combination locks.

Moreover, while being advantageous over the prior art, they are not totally immune to successful manipulation by highly skilled manipulators.

U.S. Pat. Nos. 47,575 to Sargent et al. and 57,574 to Sargent et al. disclose locks which use a magnet to attract a dog into engagement with notches in permutation wheels when retraction of a bolt is enabled. These locks require a complex apparatus including an armature for activating and deactivating the magnet. The dog is a separate member from a swing-gate that is connected to the bolt and enables retraction of the bolt.

The lock of U.S. Pat. No. 5,473,919 employs first and second magnets 62 and 64 respectively positioned on opposite sides of a drive cam gate or slot 54 and which act to repel a magnet 66 mounted in the nose 42 of a fence lever 28. While the device of this patent represents a substantial advance in the art in that it is not susceptible to opening by the vast majority of manipulations, there is a minute amount of repetitive "feel" generated by rotation of the dial which presents a remote possibility of opening of the lock by an extremely skillful manipulator.

It is the object of the present invention to provide a new and improved combination lock that is highly resistant to manipulation.

A further object of the present invention is the provision of a new and improved simple and reliable manipulation resistant combination lock wherein the lock requires relatively few parts operating in a simple and effective manner but which will not give a repetitive "feel" which would permit an unauthorized lock manipulator to open the lock.

SUMMARY OF THE INVENTION

Achievement of the aforementioned objects is achieved by the preferred embodiment of the present invention by the provision of first and second multi-surface contact rollers made of steel or other magnetically attractable material respectively mounted for easy rotation on opposite sides of a drive cam gate adjacent the outer peripheral portion of the drive cam. The first multi-surface contact roller is mounted adjacent the push side surface of the drive cam gate and the second multi-surface contact roller is mounted adjacent the pull side surface of the drive cam gate. The outer periphery of each multi-surface contact roller or body is defined by a plurality of discrete fence lever nose engagement surfaces, each of which surfaces is different from the others and is eccentrically spaced a different distance from an axis of rotation about which the multi-surface contact roller can rotate. A magnet is mounted on the nose portion of the fence lever which is designed to drop into the drive cam gate when all of the tumbler wheel gates are aligned and positioned so as to receive the fence member.

The permanent magnet is mounted on the front surface of the nose portion of the fence lever so that a magnetic force is sequentially exerted on one or the other of the multi-surface cam rollers when the nose of the fence lever is approached by the drive cam gate as a consequence of rotation of the drive cam. Moreover, the nose of the fence lever actually engages one of the engagement surfaces of the multi-surface contact roller and rotates it to position a second surface of the multi-surface in position to be engaged by the nose during a subsequent cycle of operation. Since all of the engagement surfaces are spaced different distances from the axis of rotation, a manipulator will get a different "feel" for each cycle of rotation. It is consequently impossible for a lock manipulator to determine the precise points at which the drive cam gate begins and ends. As a result, a lock manipulator cannot determine the point at which the fence lever nose can move into the drive cam gate and therefore cannot defeat the lock.

BRIEF DESCRIPTION OF THE DRAWINGS

The invention will be better understood by reading the following detailed description of the preferred embodiments in which the dial of the lock on which the dial is provided is the "front" of the lock and the opposite side is the "rear" of the lock with reference to the accompanying drawing figures, in which like reference numerals refer to like elements throughout, and in which.

DETAILED DESCRIPTION OF THE PREFERRED EMBODIMENTS

Figure 1:
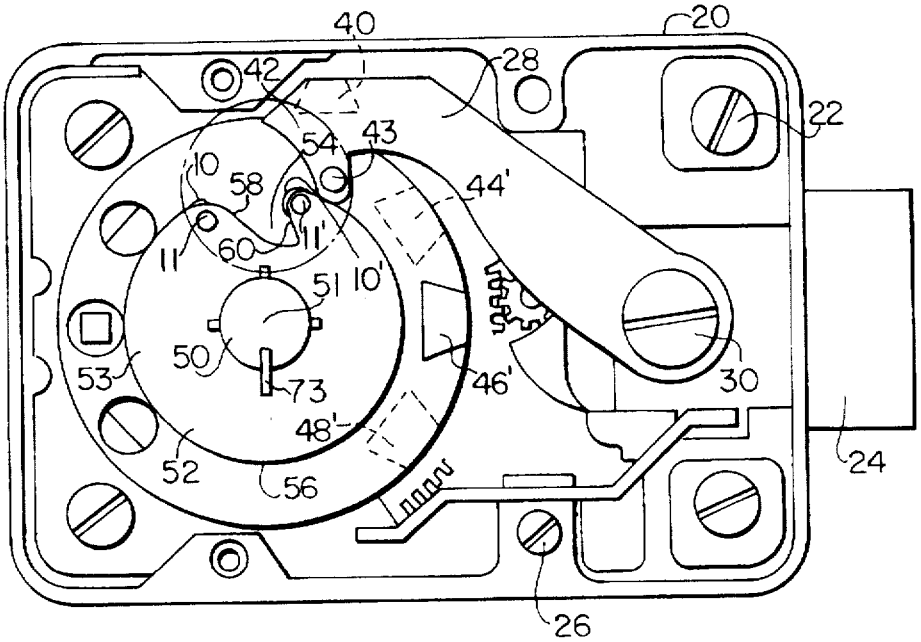
FIG. 1 is a rear elevation view, with the cover removed, of the manipulation resistant combination lock with the nose of the fence lever contacting the outer periphery of the drive cam.

In describing preferred embodiments of the present invention illustrated in the drawings, specific terminology is employed for the sake of clarity. However, the invention is not intended to be limited to the specific terminology so selected, and it is to be understood that each specific element includes all technical equivalents which operate in a similar manner to accomplish a similar purpose.

Referring initially to FIG. 1, the exemplary lock is for the most part identical to the lock shown in U.S. Pat. No. 5,473,919 which is incorporated herein by reference. The lock includes a housing 20 mounted on or in a safe door or the like (not shown) by appropriate mounting screws 22 in known fashion. The lock includes a bolt 24 which is adapted to be received within a receptacle in a wall of the safe or the like (not shown) in conventional manner. A rear cover (not shown) can be held in place on housing 20 by cover screws.

As shown in FIG. 1, a fence lever 28 is pivotally mounted at one end by a pivot screw 30 secured to bolt 24 and has a fence 40 protruding forwardly from an opposite distal end of fence lever 28 in parallel relation to the axis of pivot screw 30. Fence 40 is adapted to cooperate in known manner with gates 44', 46' and 48', respectively, of conventional tumbler wheel assembly. Such tumbler wheel assemblies are generally formed with an inner drive ring manipulated by rotation of drive shaft 50 and have an outer relatively adjustable gate ring as more fully disclosed in U.S. Pat. No. 4,142,388, for example, which is herein incorporated by reference, however, other types of tumbler wheel assemblies can be employed if desired.

Figure 2:
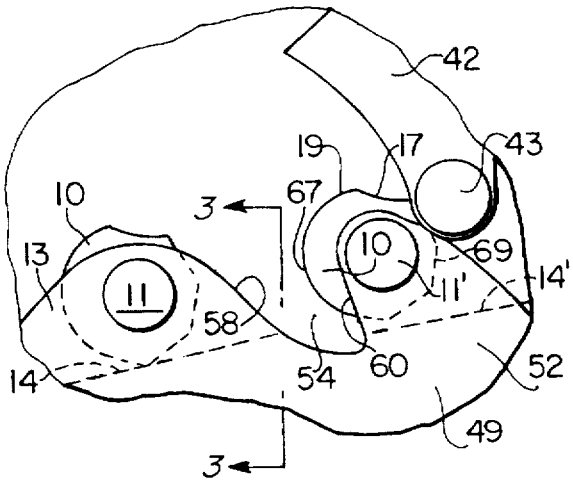
FIG. 2 is an enlarged view of a portion of FIG. 1 encircled in phantom lines and labeled FIG. 2 in FIG. 1.

Drive cam 52 has a rear surface 49 and front surface 55 and is provided on the rear end of drive shaft 50 to which it is drivingly connected by key 73. Drive cam 52 includes a cam gate 54 having a pushing surface 58 and a pulling surface 60 and dimensioned to receive and cooperate with nose portion 42 of fence lever 28 as best seen in FIGS. 1 and 2. Fence lever 28 is urged toward drive cam 52 by spring or other means not shown. When fence lever nose portion 42 is positioned in drive cam gate 54, (a condition allowed only when the combination has been correctly dialed and tumbler wheel gates 44', 46' and 48' are aligned so that fence 40 is received in the aligned tumbler wheel gates 44', 46' and 48') further counterclockwise rotation of drive shaft 50 as viewed in FIG. 1 will operate to cause drive cam gate pulling surface 60 to engage and retract pull bolt 24 to the left out of the wall receptacle, not shown, to cause unlocking of the combination lock.

It is an unfortunate fact that unauthorized opening of many combination locks can be achieved by "manipulators" by turning the lock dial and its associated drive shaft to bring portions of the tumbler wheels, and particularly their gates, in contact with the fence so as to enable the manipulator to manually sense the tumbler gate positions and eventually deduce the combination. For this reason, fence lever nose portion 42 normally rides on the outer periphery 56 of drive cam 52, thereby holding fence 40 out of contact with tumbler wheel gates 44', 46' and 48', as shown in FIG. 1. However, it has also been found that the more skillful manipulators can use even slight indications or "feel" imparted to the dial by the engagement of fence lever nose portion 42 with the drive cam peripheral surface portions adjacent gate 54 which merge into gate pushing surface 58 or drive cam gate pulling surface 60 in a lock manipulation procedure which enables such person to determine the combination of the lock and then open it. Previously noted U.S. Pat. No. 5,473,919 employs a magnet mounted in the nose and two other magnets respectively mounted on opposite sides of the cam gate in opposing force relationship to the magnet in the lever nose so as to reduce the ability of a manipulator to determine the gate position. It is a primary object of the present invention to provide a simplified, and improved arrangement for variably changing the contour of the path of fence lever 28 as it approaches the drive cam gate in a random manner for each cycle of operation in order to preclude a lock manipulator from feeling the precise location of drive cam gate 54 so as to permit eventual ascertainment of the lock combination.

Figure 3:
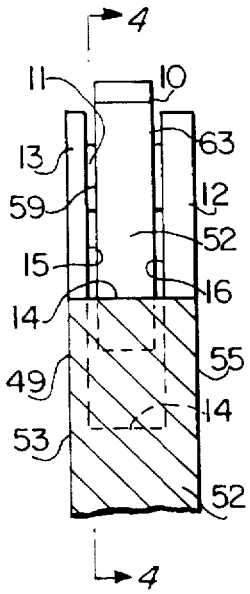
FIG. 3 is a sectional view taken along line 3—3 of FIG. 2 showing the manner in which the first multi-surface contact roller is mounted in the drive cam.
Figure 4:
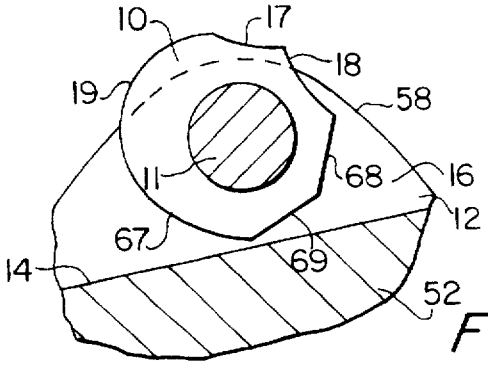
FIG. 4 is an enlarged sectional view taken along line 4—4 of FIG. 3.

Achievement of the objects of the invention is enabled by the provision of a pushing side multi-surface contact roller or body 10 having a rear surface 59 and a front surface 63 mounted as shown in FIG. 3 for rotation on a pivot pin 11 extending across a pushing side slot provided in drive cam 52 and having a bottom surface 14 formed between a front plate 12 and a rear plate 13 of drive cam 52. The sides of the slot are defined by inner surface 16 of front plate 12 and inner surface 15 of rear plate 13. The slot between plates 12 and 13 is provided by cutting a chordal slot or groove transversely through the portion of drive cam 52 on the pushing surface side of drive gate 54 as shown in FIGS. 2, 3 and 4. The axis of pivot pin 11 is parallel to the axis of rotation 51 of the drive cam 52 and is the axis of rotation of roller 10.

A pulling side multi-surface contact roller or body 10' identical to the pushing side multi-surface contact roller 10 is provided near the outer periphery of drive cam 52 immediately adjacent the drive cam gate pulling edge 60 as best shown in FIG. 2. The mounting of the pulling side multi-surface contact roller 10' is identical to the mounting of the pushing side multi-surface contact roller 10 and the corresponding components for providing the mounting for roller 10' have the same reference numerals as the corresponding components for roller 10 except for the fact that the reference numerals have been primed.

The rollers 10 and 10' are identical in the disclosed embodiment and attention is invited to FIG. 4 which best illustrates the configuration of roller 10 which is identical to that of roller 10'. The outer peripheral surface is defined by a plurality of different surfaces including a first arcuate surface 17 and a second arcuate surface 18 both of which arcuate surfaces have centers of curvature external of the roller 10. Similarly, a third arcuate surface 19 and a fourth arcuate surface 67 have centers of curvature internally of the contact roller 10. Lastly, the roller 10 also has two planar surfaces 68 and 69. Both of the multi-surface contact rollers 10 and 10' are formed of magnetically attractable material such as steel.

Nose portion 42 of fence lever 28 is provided with a cylindrical permanent magnet 43 mounted in a bore provided in the nose portion 42 and extending rearwardly of the rear surface of the nose portion 42. Magnet 43 exerts an attracting force on the multi-surface contact rollers 10 and 10' which is capable of causing a small amount of rotation of the rollers in some instances when the magnetic force is acting on portions of the rollers that are eccentric to the axis of rotation of the rollers.

Rotation of drive cam 52 in a clockwise direction as viewed in FIG. 1 will cause the pulling side multi-surface contact roller 10' to eventually contact the edge surface of nose portion 42 as shown in FIG. 2. It should be understood that the angular position of drive cam 52 at the moment of contact of nose 42 with roller 10' will depend upon the rotational position of roller 10' relative to its support pin 11'. For example, if the first arcuate surface 17 is facing the lower end of nose portion 42, drive cam 52 will rotate a greater distance before contact between the roller and the nose portion 42 than would be the case if the third arcuate surface 19 was facing the lower end of the nose prior to contact with the nose.

In any event, prior to nose portion contact with roller 10', the magnetic attraction of magnet 43 on the multi-surface contact roller 10' will sometimes act upon roller 10' to cause it to rotate prior to any contact with the nose 42. When contact occurs, as a consequence of clockwise rotation of drive cam 52 with the parts in the position shown in FIG. 2, continued rotation of the drive cam 52 will cause the lower end of nose 42 to rotate the roller 10' in a counterclockwise direction so that the roller assumes a new or second position relative to the drive cam which it will still be if the nose again contacts it after subsequent rotation of drive cam 52.

Thus, roller 10' will always be in a different rotational position on pin 11' when it next contacts nose 42 and the contact will occur at random rotational positions of the drive cam. The action of magnet 43 on the roller 10' as nose 42 moves past and separates from the roller is not totally predictable in that it depends upon the initial position of roller 10' at the time of initial contact with nose 42 so that the magnet sometimes causes a small amount of reverse rotation of the roller as the nose and roller separate. The foregoing relationship also obviously applies during clockwise rotation of drive cam 52 when the nose portion first crosses over drive gate 54 to engage roller 10 and is also equally applicable when the drive cam 52 is rotating in a counterclockwise direction. Thus, a manipulator would receive a different feel at the dial which would randomly vary each time the nose 42 engages either of the rollers 10 or 10' and would consequently be unable to detect a pattern which would enable determination of the gate position and for the combination of the lock. In fact, the assignee of this application has had a skilled manipulator attempt to determine the combination and the manipulator was unable to do so after substantial time spent in manipulation of the subject lock.

Modifications and variations of the above-described embodiments of the present invention are possible, as will be appreciated by those skilled in the art in light of the above teachings. For example, the number and nature of the various surfaces on rollers 10 and 10' can vary in countless manner; moreover rollers 10 and 10' need not be identical. In some instances a magnet 43 may not be employed.

It is therefore to be understood that, within the scope of the appended claims and their equivalents, the invention may be practiced otherwise than as specifically described.

LIST OF DESIGNATORS

10—pushing side multi-surface contact roller or body
10'—pulling side multi-surface contact roller
11—pivot pin
11'—second pivot pin
12—rear plate
13—front plate
14—bottom surface of groove
14'—bottom surface of the groove
15—inner surface of front plate
16—inner surface of rear plate
17—first arcuate surface
18—second arcuate surface
19—third arcuate surface
20—housing
22—mounting screws
24—bolt
26—cover screws
28—fence lever
30—pivot screw
40—fence
42—nose portion
43—cylindrical permanent magnet
44'—tumbler wheel gate
46—tumbler wheel
46'—tumbler wheel gate
48'—tumbler wheel gate
49—rear surface of drive cam
50—drive shaft
51—axis of rotation
52—drive cam
53—rear surface
54—drive gate
55—front surface of drive cam
56—drive cam periphery
58—drive cam gate pushing surface
59—rear surface
60—drive cam gate pulling surface
63—front surface
67—fourth arcuate surface
68—planar surface
69—planar surface
73—key

What is claimed is:

1. An improved manipulation resistant combination lock including manipulation defeating means for impeding unauthorized opening of the combination lock through manipulation of the lock components, wherein said lock includes:

a housing;

a bolt slidably mounted for movement in the housing between a locked extended position and an unlocked retracted position;

a pivotably mounted movable fence lever having a nose portion;

a fence member mounted on said fence lever;

a drive cam mounted for rotation in said housing and having an outer periphery in which a drive gate having a pulling surface and a pushing surface is provided;

said nose portion of said movable fence lever being urged into contact with the outer periphery of said drive cam;

a plurality of tumbler wheels that are alienable with said fence member when said tumbler wheel gates are positioned in a predetermined manner;

a pulling side multi-surface contact roller mounted for rotation about a roller rotation axis on said rotary drive cam adjacent the outer periphery of said rotary drive cam and also adjacent said pulling surface of said drive gate and positioned to engage said nose portion in response to rotation of said drive cam;

a pushing side multi-surface contact roller mounted for rotation about a roller rotation axis on said rotary drive cam adjacent the outer periphery of said drive cam and also adjacent said pushing surface of said drive gate and positioned to engage said nose portion in response to rotation of said rotary drive cam;

a first one of said multi-surface contact rollers having a plurality of non-identical nose contact surfaces each of which is uniquely radially positioned and oriented relative to the rotation axis of said first multi-surface contact roller so that said nose portion will engage one of said nose contact surfaces in response to rotation of said one drive cam and cause rotation of said multi-surface contact roller to position another one of said nose contact surfaces for engagement by said nose portion during a subsequent rotation of said drive cam so that the angular position of the drive cam at each time of contact of said one multi-surface contact roller is randomly variable for each such contact so as to prevent repetitive manually detectable characteristics during subsequent rotation of the drive cam.

2. The manipulation resistant combination lock of claim 1 wherein:

the contact surfaces of said first multi-surface contact roller include at least one smoothly curved surface.

3. The manipulation resistant combination lock of claim 1 wherein:

the contact surfaces of said first multi-surface contact roller include planar surfaces.

4. The manipulation resistant lock of claim 3 wherein:

the contact surfaces of said first multi-surface contact roller additionally include smoothly curved surfaces.

5. The manipulation resistant lock of claim 2 wherein:

at least one of said smoothly curved surfaces has a center of curvature externally located relative to said first multi-surface contact roller.

6. The manipulation resistant lock of claim 5 wherein at least one of said smoothly curved surfaces has a center of curvature located internally of said first multi-surface contact roller.

7. The manipulation resistant lock of claim 5 wherein said first multi-surface contact roller has two smoothly curved surfaces which are adjacent each other and have a common border.

8. The manipulation resistant lock of claim 7 wherein said first multi-surface contact roller has two planar surfaces which are adjacent each other and share a common border.

9. The manipulation resistant lock of claim 8 wherein each of said multi-surface contact rollers is made of magnetically attractable material and additionally including a magnet on said drive cam positioned to exert sufficient magnetic force on said multi-surface contact rollers in response to rotation of said drive cam to cause a limited amount of rotation of said multi-surface contact rollers when said multi-surface contact rollers are in the near vicinity of said magnet.

10. In a combination lock having a pivotal fence lever having a nose portion urged against a dial driven rotary drive cam having an outer periphery adjacently facing the fence lever and an inwardly extending drive gate having first and second sides, the improvement comprising:

a rotatable contact roller mounted for unlimited rotation on a support pin having an axis and having an outer periphery including discrete surfaces extending about and defining the outer periphery of said contact roller each oriented differently to the other and with each discrete surface being spaced a different distance from the axis of the support pin; said support pin being mounted on the drive cam adjacent the periphery of said drive cam and adjacent one side of said drive gate so that one of said discrete surfaces contacts said nose portion during rotation of said rotary drive cam so that said drive cam rotates the contact roller sufficiently so that the nose portion contacts another one of said discrete surfaces during subsequent rotation of said drive cam so as to create a different feel at the dial and reduce the possibility that manipulation of the lock cam reveals the combination.

11. In a combination lock as recited in claim 10, additionally including:

a second rotatable contact roller mounted on a second support pin on the drive cam and having an axis and an outer periphery including multiple discrete surfaces each oriented differently to the other and with each discrete surface being spaced a different distance from the axis of the second support pin; said second support pin being mounted on the drive cam adjacent the periphery of said drive cam and adjacent the other side of said gate so that one of the discrete surfaces of said second rotatable contact roller contacts said nose portion with one of its surfaces during rotation of said rotary drive cam so that said drive cam rotates the second rotatable contact roller sufficiently so that the nose portion contacts another one of said surfaces of said second rotatable contact roller during subsequent rotation of said drive cam so as to create additional different feel and additionally reduce the possibility of manipulation of the lock revealing the combination.

12. The combination lock of claim 11 wherein:

said multiple discrete surfaces of said first and second contact rollers each include smoothly curved surfaces.

13. The combination lock of claim 12, wherein:

said multiple discrete surfaces of said first and second contact rollers include planar surfaces.

14. A method of preventing successful manipulation of a combination lock having a dial driven drive cam having a peripheral surface and a drive gate and a pivotal fence lever with a nose portion urged into contact with the peripheral surface of the drive cam, said method comprising the steps of:

(a) rotating the drive cam to cause the drive gate to approach said nose portion so that the nose portion engages a first surface of a multi-surface contact body mounted on the drive cam in a first relative position to said drive cam at a time when said drive cam is in a first angular position of rotation to result in a first manual feel at the dial and (b) continuing rotation of said drive cam so that said nose portion rides over and moves said multi-surface contact body to a second position relative to said drive cam following which the nose portion moves out of contact with said multi-surface contact body, said second position being such that a second surface of said multi-surface contact body is then positioned so as to be subsequently engageable by said nose portion when said drive cam is in a second angular position of rotation so as to result in a second manual feel at the dial different from said first manual feel so as to prevent a manipulator from manually determining the position of the drive gate.

15. The method of claim 14 including the further steps of subjecting said multi-surface contact body to magnetic force of sufficient force to rotate said multi-surface contact body an incremental distance prior to the engagement of the nose portion therewith as recited in paragraph (a).

16. The method of claim 14 including the additional steps of:

(c) after step (b) subsequently rotating the drive cam to cause the drive gate to approach said nose portion so that the nose portion engages a first surface of a second multi-surface contact body mounted on the drive cam in a first relative position to said drive cam at a time when said drive cam is in a third angular position of rotation to result in a third manual feel at the dial and (d) continuing rotation of said drive cam so that said nose portion rides over and moves said second multi-surface contact body to a second position relative to said drive cam in which a second surface of said second multi-surface contact body is then positioned so as to be engageable by said nose portion when said drive cam is in a fourth angular position of rotation so as to result in a fourth manual feel at the dial different from said first manual feel so as to prevent a manipulator from manually determining the position of the drive gate.

17. The method of claim 14 wherein said continued rotation of said drive cam as recited in paragraph (b) causes said nose portion to cross over said drive gate and engage a second multi-surface contact body located on the opposite side of said drive gate from said first multi-surface contact body so as to result in a further manual feel at the dial following which said second multi-surface contact body is repositioned relative to said drive cam so that an additional different manual feel at the dial will result in the event of subsequent contact of said nose portion with said second multi-surface contact body.

18. A method of preventing successful manipulation of a combination lock having a dial driven rotary drive cam rotated by a manually operated dial and having a peripheral surface and a drive gate and a pivotal fence lever having a cam contacting portion urged into contact with the peripheral surface of the drive cam, said method comprising the steps of:

(a) rotating the drive cam in response to dial rotation to cause the drive gate to approach said cam contacting portion of the fence lever so that the cam contacting portion engages a first surface of a multi-surface contact body mounted on the drive cam in a first angular position relative to the drive cam so that said engagement occurs when said drive cam is in a first angular position of rotation to result in a first manual feel at the dial; and (b) repositioning said multi-surface contact body relative to said drive cam following further rotation of said drive cam so that said multi-surface contact body is repositioned relative to said drive cam to position a second surface of the multi-surface contact body in a second angular position relative to the drive cam which is different from said first angular position following which the cam contacting portion disengages said multi-surface contact body which is positioned so that any subsequent engagement of the cam contacting portion with said multi-surface contact body will occur with said drive cam being in a second angular position of rotation which is different from said first angular position of rotation so as to create a manual feel on the dial that is different from said first manual feel.

* * * * *